United States Patent [19]

Kikuchi et al.

[11] Patent Number: 4,687,361

[45] Date of Patent: Aug. 18, 1987

[54] RACK MOUNT FOR A RACK AND PINION CARRIAGE MOVING MECHANISM

[75] Inventors: Hiroshi Kikuchi; Kuniharu Hayashi; Minoru Isobe; Jiro Tanuma; Masanori Maekawa, all of Tokyo, Japan

[73] Assignee: Oki Electric Industry Co., Ltd., Tokyo, Japan

[21] Appl. No.: 836,512

[22] Filed: Mar. 5, 1986

[30] Foreign Application Priority Data

Mar. 7, 1985 [JP] Japan ..... 60-43619
Mar. 15, 1985 [JP] Japan ..... 60-37258[U]

[51] Int. Cl.[4] ..... B41J 19/30

[52] U.S. Cl. ..... 400/322; 400/320; 400/332; 74/422

[58] Field of Search ..... 400/298, 320, 322, 323, 400/328, 332, 332.5, 332.6, 352, 354, 287, 288, 296, 296.1, 296.2, 307, 307.2; 74/422; 360/106, 109

[56] References Cited

U.S. PATENT DOCUMENTS 565,728 8/1896 Fairfield ..... 400/332.5
1,525,326 2/1925 Seib ..... 400/298
2,741,355 4/1956 Dodge ..... 400/332.6
3,946,852 3/1976 Watson et al. ..... 400/328
4,526,486 7/1985 Kikuchi et al. .

FOREIGN PATENT DOCUMENTS 234763 6/1925 United Kingdom ..... 400/332.5

*Primary Examiner*—Edgar S. Burr
*Assistant Examiner*—David A. Wiecking
*Attorney, Agent, or Firm*—Wenderoth, Lind & Ponack

[57] ABSTRACT

A carriage moving mechanism includes a carriage movably mounted on a guide shaft, a travelling motor fixedly mounted on the carriage, the travelling motor including a pinion mounted on a rotary shaft thereof, a rack provided in substantially parallel to the guide shaft, the rack being rigid longitudinally and flexible in a perpendicular direction to the longitudinal direction, the rack having longitudinally a tooth part engaged with the pinion, the surface of the rack located on the opposite side of the surface of the tooth part being substantially parallel to the guide shaft, a roller rotatably mounted on the carriage, the roller radially facing to the pinion and making contact with the opposite side surface to the tooth surface of the rack, the rack being rotatably mounted on the frame in one end thereof and restricted by the frame in the other end thereof in the extent of moving thereof or directly fixed on the frame in the other end thereof.

6 Claims, 7 Drawing Figures

RACK MOUNT FOR A RACK AND PINION CARRIAGE MOVING MECHANISM

BACKGROUND OF THE INVENTION

1. Field of the Invention:

The present invention relates to a carriage moving mechanism for moving a carriage for use in a printer and the like.

2. Description of the Prior Art:

A prior carriage moving mechanism is known for use in for example an impact type printer, etc., wherein a carriage having a printing head, etc., mounted thereon is movably attached to a guide shaft while a travelling motor such as a brushless motor is fixedly mounted on the lower surface of the carriage with a pinion mounted on a rotary shaft of the motor, the pinion being engaged with a metal rack disposed in parallel to the guide shaft.

The carriage moving mechanism serves to move the carriage along the guide shaft by a thrust force produced due to rotation of the pinion in engagement with the rack, the pinion being fixed on the rotary shaft of the motor, by running the moving motor. The carriage travelling mechanism can reciprocate the carriage with use of the positive and negative two directional rotations of the pinion caused by the motor.

However, the prior carriage moving mechanism must mount both ends of the rack on a base frame, etc., so as to permit the rack to be parallel to the guide shaft. Accordingly, mounting and adjustment become difficult. In addition, since the rack is made of rigid metal accurate feed of the carriage is difficult due to backlash produced between the rack and the pinion. Furthermore, the travelling motor is likely to be subjected to additional load in moving of the carriage owing to the backlash as well as an insufficient parallel relation between the guide shaft and the rack.

Moreover, since the rack must have a tooth part formed by cutting a metal raw material with sufficient accuracy to be engaged with the pinion, it requires a high level of manufacturing technology at the sacrifice of its being costly.

SUMMARY OF THE INVENTION

In view of the drawbacks of the conventional carriage moving mechanism, it is an object of the present invention to provide a carriage moving mechanism capable of mounting a rack thereon with ease without requiring adjustment of parallelism of the rack to a guide shaft, while also being capable of forcing the carriage to travel with use of an inexpensive rack easy to be manufactured as well as reducing any load additionally applied to a travelling motor.

To achieve the above object, a carriage moving mechanism according to the present invention comprises:

(1) a carriage movably mounted on a guide shaft, (2) a travelling motor fixedly mounted on said carriage including a pinion attached to a rotary shaft of said motor, (3) a rack provided substantially in parallel to said guide shaft, (4) said rack being rigid longitudinally thereof and being flexible in a direction perpendicular to said longitudinal direction, said rack including a tooth part adapted to engage with said pinion, the surface of the rack the tooth being substantially parallel to said guide shaft, (5) a roller rotatably mounted on said carriage and adapted to radially face the pinion as well as to make contact with the surface of said rack in opposition to said tooth surface of the rack, and (6) one end of said rack being rotatably mounted on a frame, while the other end of said rack being directly fixed on the frame or fixed via an elastic member or fixed via a twisted elastic member.

The above and other objects, features and advantages of the present invention will become more apparent from the following description when taken in conjunction with the accompanying drawings in which preferred embodiment of the present invention is shown by way of illustrative example.

DETAILED DESCRIPTION OF THE PREFERRED EMBODIMENT

Embodiments of a carriage moving mechanism according to the present invention will be described with reference to the accompanying drawings.

Figure 1:
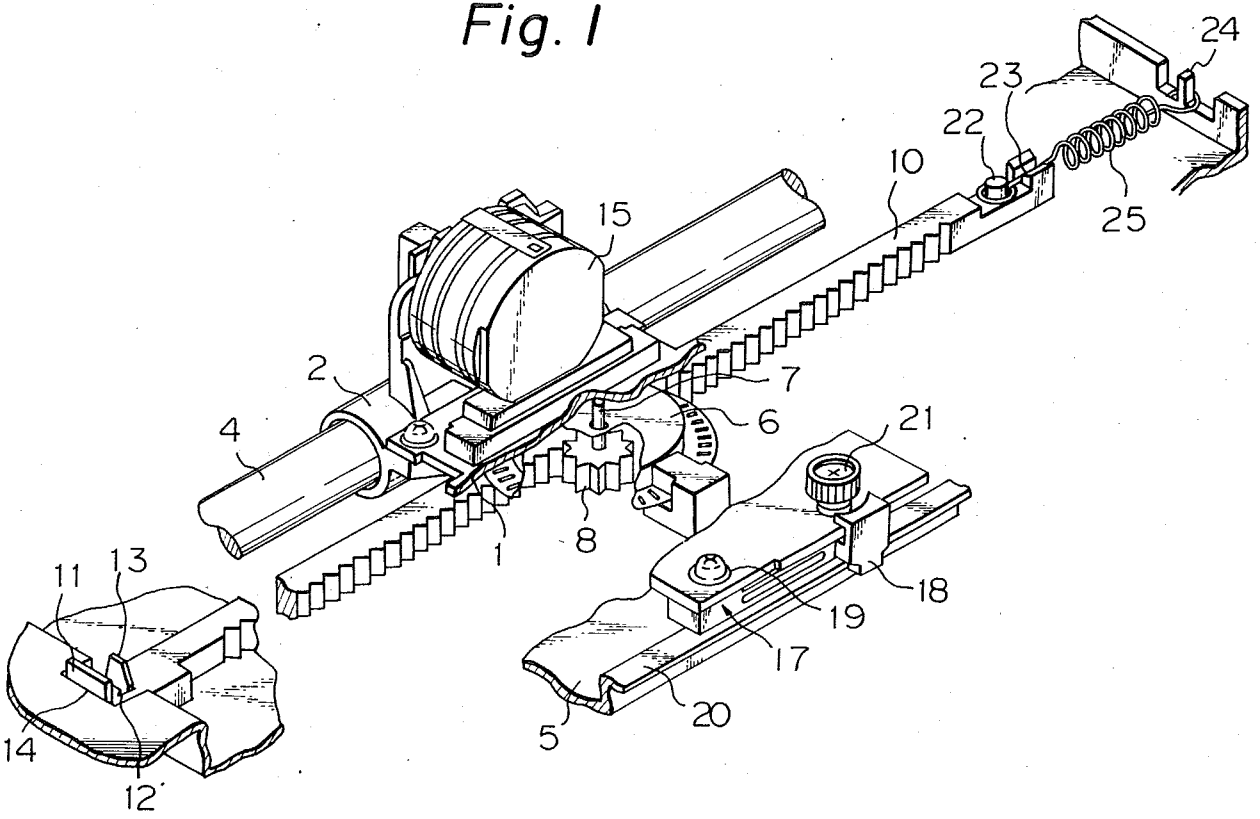
FIG. 1 is a perspective view, partly fractured, illustrating a carriage moving mechanism.
Figure 2:
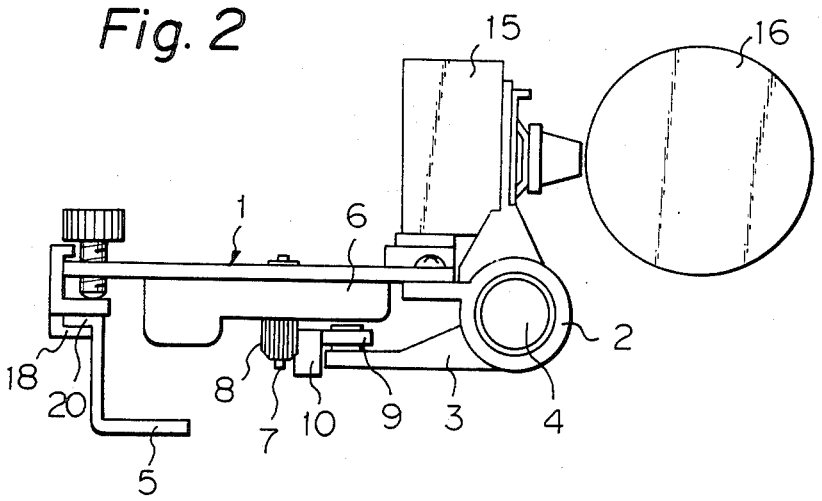
FIG. 2 is a side elevational view of the same.

As shown in FIGS. 1 and 2 showing a carriage moving mechanism according to the present invention, designated at 1 is a carriage, and designated at 2 is a cylindrical part provided on the front of the carriage 1 and having an arm 3 formed thereon as shown in FIG. 2.

Designated at 4 is a guide shaft fixedly mounted at each end on a side plate, etc., (not shown) adapted to stand on a base plate 5 of a printer, the carriage 1 being movably attached to the guide shaft 4 via the cylindrical portion 2.

Likewise, designated at 6 is a travelling motor fixed on the lower surface of the carriage 1 and adapted to have a pinion 8 attached to a rotary shaft 7 of the travelling motor 6, and designated at 9 is a roller rotatably supported on the arm 3 of the carriage 1 in opposition radially to the pinion 8 and spaced away by a prescribed interval.

Figure 4:
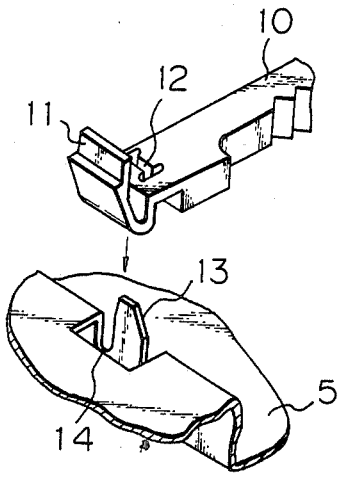
FIG. 4 is a perspective view illustrating a mounting portion between a frame and a rack.

Designated at 10 is a flexible rack comprising polyamide resin and the like and being rigid longitudinally thereof as well as flexible in a flex direction perpendicular to the longitudinal direction. The rack 10 has a stop pawl 11 elastically displaceable as shown in FIG. 1 (in detail, refer to FIG. 4) on its one end and a stop hole 12 provided therein, I-shaped, for example, in its cross section. The rack is mounted on the base plate 5 by fitting a projection 13 adapted to stand on the base plate 5 (so as to extend perpendicularly to the flex direction and the longitudinal direction) in the stop hole 12 while engaging the stop pawl 11 with a stopper part 14 provided in the vicinity of the projection 13.

Hereupon, the stop hole 12 is set to be slightly larger than the thickness and width of the projection 13 whereby the rack 10 is made rotatable (pivotable) horizontally with respect to the projection 13 while being restricted in space to a certain region. In the present embodiment, the rack 10 so made rotatable is put between the pinion 8 and the roller 9 to bring a tooth part of the rack 10 and that of the pinion 8 into engagement with each other, while the rack 10 is pressed to the pinion 8 side owing to the roller 9.

Furthermore, with the stop hole 12 round-shaped, a cylindrical shaft may be provided on the base plate 5 instead of the projection 13 and the cylindrical shaft may be fitted in the round-shaped stop hole 12 for rotatably mounting one end of the rack 10 on the base plate 5.

Designated at 15 is a printing head mounted on the carriage 1, the printing head being provided for printing any data on a paper (not shown) set on the platen 16 of FIG. 2 following the travelling of the carriage 1.

Figure 3:
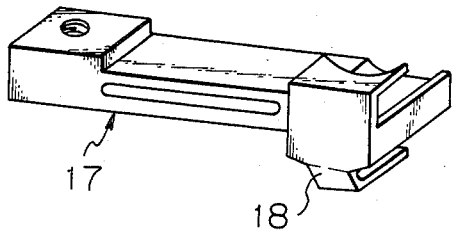
FIG. 3 is a perspective view showing a parallel link member.

Likewise, designated at 17 is a parallel link member mounted on the rear end of the carriage 1 illustrated in detail in FIG. 3. The parallel link member 17 has a slider 18 and is fixed on the carriage 1 via a screw 19. The slider 18 is engaged slidably with a rail part 20 formed or mounted integrally with the base plate 5. Designated at 21 is a platen gap (a gap between the platen 16 and the printing head 15) adjusting screw, whose tip makes contact with the upper part of the slider 18. The carriage 1 is rotated on the guide shaft 4 by turning the adjusting screw 21 clockwise or anticlockwise, and thereby the platen gap is made changeable.

On the other hand, the other end of the rack 10 has a post 22 and a groove 23 in close vicinity of the post 22, and a coil spring 25 is trained between the post 22 and a second projection 24 formed by partly notching the base plate 5 in the close vicinity of the other end of the guide shaft 4.

Operation of the above arrangement will now be described.

With the rotary shaft 7 positively rotated by driving the travelling motor 6, the pinion 8 is, while engaged with the rack 10, rotated integrally with the rotary shaft 7 to produce thrust force whereby the carriage 1 travels in a prescribed direction along the guide shaft 4.

With the travelling motor 6 driven so as to permit the rotary shaft 7 to be reversely rotated, the pinion 8 is also reversely rotated integrally with the rotary shaft 7 whereby the carriage 1 travels oppositely to the above travelling direction.

Accordingly, the carriage 1 can be adapted to travel in the forward and backward directions in a reciprocating manner along the guide shaft 4.

In the present embodiment, the rack 10 is adapted to be rotatable around (pivotable about) one end thereof. Accordingly, although the rack 10 tends to run away owing to the force produced by the rotation of the pinion 8, engagement between the rack 10 and the pinion 8 is assured at all times since a portion at which the rack 10 and the pinion 8 are engaged with each other is pressed against the pinion 8 by the roller 9 supported on the arm 3 of the carriage 1. In addition, since the rack 10 is flexible, an insufficient parallel relation between the guide shaft 4 and the rack 10 and backlash between the rack 10 and the pinion 8 are absorbed.

Therefore, it is possible to permit the carriage 1 to accurately travel together with the reduction of any load applied to the motor 6 upon the travelling of the carriage 1.

Next, another embodiment will be described with reference to FIGS. 1 to 4 and FIGS. 5(A), 5(B) and 6. The present example is the same as the previous one excepting how to mount the coil spring 25.

In the present example, the coil spring 25 shown in FIG. 1 is as follows.

Namely, the coil spring 25 is adapted to be previously different, in its angle between a substantially annular stopper part **25*a* provided on one end of the coil spring 25 and a similar one 25*b* provided on the other end of the same, from each other by about 90 degree around the axis of the coil spring. In addition, the stopper part 25*b* is hung on the post 22 of the rack 10 while a linear part between the stopper part 25*b* and a helical part is adapted to pass through the groove 23, and further the stopper part 25*a* is, while twisted by about 90 degree, hung on the second projection 24 of the base plate 5. Hereby, the coil spring 25 is trained between the post 22 and the second projection 24 whereby the rack 10 is prevented from being horizontally twisted by allowing the spring 25 to pull the other end of the rack 10 while the rack 10 is pressed against the pinion 8 to permit the rack 10 and the pinion 8 to be engaged with each other without any backlash due to reaction force produced owing to the horizontal twisting as described before, as shown by an arrow in FIG. 6**.

Figure 5:
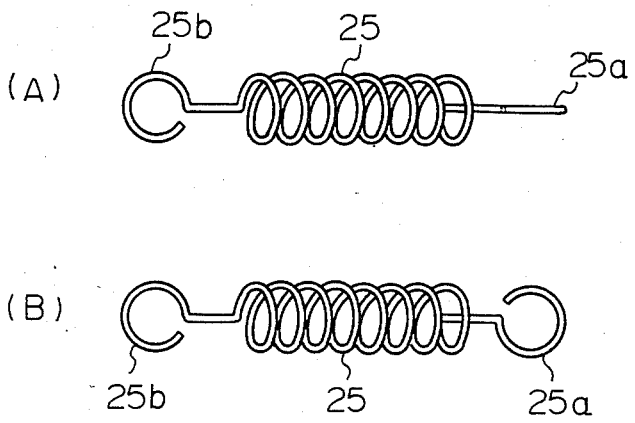
FIGS. 5(A) and 5(B) are respective plan views showing a coil spring in different positions.
Figure 6:
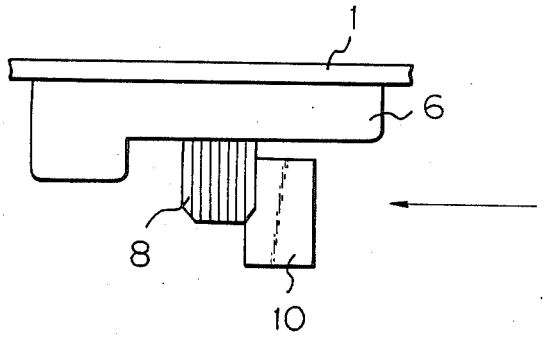
FIG. 6 is a side elevational view of portions of the rack and the pinion illustrating engagement therebetween.

Hereupon, provided that the second projection 24 is perpendicular to the post 22, i.e., the post 22 and the second projection 24 are respectively formed vertically and horizontally, the same effect can be assured by a procedure as described below. Namely, the spring 25 is first formed as shown in FIG. 5 (B) and the stopper **25*a* is provided, by twisting it about 90 degree as shown in FIG. 5(A), upon hanging the stopper part 25*a* on the second projection 24**.

Then, an effect of the arrangement described above will be described.

With the rotary shaft 7 positively rotated by driving the travelling motor 6, the pinion 8 is, while engaged with the rack, rotated integrally with the rotary shaft 7 to produce thrust force whereby the carriage 1 travels in a prescribed direction along the guide shaft 4.

While, with the travelling motor 8 driven so as to permit the rotary shaft 7 reversely rotated, the pinion 8 is also reversely rotated integrally with the rotary shaft 7. Accordingly, the carriage 1 travels in the opposite direction to the above travelling direction thereof owing to the thrust force produced as described above.

As a result, the carriage 1 can be moved in forward and backward directions along the guide shaft 4.

In the present embodiment, although the rack 10 is adapted to be rotatable around (pivotable about) one end thereof within the prescribed limit, the other end is prevented from being horizontally twisted due to tensile force of the coil spring if trained between the post 22 and the projection 24, and an engagement portion between the rack 10 and the pinion 8 and the roller 9 supported on the arm 3 of the carriage 1 in a sandwiching relation, whereby the engagement between the rack 10 and the pinion 8 can be assured at all time.

In addition, since the rack 10 is flexibly constructed, and the rack 10 is pressed against the pinion 8 side due to a reaction force yielded by twisting one end of the coil spring 25, an insufficient parallel relation of the guide shaft 4 to the rack 10 and any backlash between the rack 10 and the pinion 8 are both moderated.

Consequently, the rack 10 and the pinion 8 are engaged with each other without producting any backlash therebetween, whereby the carriage 1 can be accurately moved together with the reduction of any load applied to the traveling motor 6 upon traveling of the carriage 1.

Hereupon, although the above embodiment is described as a carriage moving mechanism in a printer, it goes without saying that any apparatus having a carriage function may be applied without any limitation on the present invention.

Although certain preferred embodiments have been shown and described, it should be understood that many changes and modifications may be made therein without departing from the scope of the appended claims.

What is claimed is:

1. A carriage moving mechanism comprising:

(a) a carriage mounted for movement in a longitudinal direction on a longitudinally extending guide shaft;

(b) a traveling motor fixedly mounted on said carriage, said traveling motor including a pinion mounted on a rotary shaft thereof;

(c) a rack extending substantially in parallel to said guide shaft; said rack being rigid longitudinally and flexible in a flex direction perpendicular to said longitudinal direction, said rack having a longitudinally extending tooth surface engaged with said pinion, another surface of said rack located opposite to said tooth surface being substantially parallel to said guide shaft, said tooth surface and said other surface being spaced apart in said flex direction, said rack having a stop pawl and a stop hole at one longitudinal end thereof;

(d) a roller rotatably mounted on said carriage, said roller radially facing said pinion and making contact with said other surface of said rack so as to resist disengagement of said tooth surface from said pinion;

(e) an elastic member; and (f) a frame having a projection extending perpendicularly to said longitudinal direction and said flex direction, and a stopper part, said projection projecting through said stop hole, said stop pawl engaging said stopper part, said rack being elastically connected to said frame at an end of said rack opposite said one end through said elastic member so as to elastically resist disengagement of said tooth surface from said pinion, and pivotally connected to said frame at said one end of said projection through said stop hole, such that said rack is pivotable about said projection.

2. A carriage moving mechanism according to claim 1, wherein said elastic member for connecting said rack to said frame is a coil spring.

3. A carriage travelling mechanism according to claim 2, wherein said coil spring is mounted while twisted by about 90 degree around an axis of said spring.

4. A carriage moving mechanism as in claim 1, wherein said rack and said guide shaft are horizontally extending and horizontally spaced from each other, said direction perpendicular to said longitudinal direction being a horizontal direction so that said rack is flexible in a horizontal plane, said tooth surface and said other surface being formed on horizontally opposite sides of said rack, said roller and said pinion having vertically extending axes of rotation so that said roller rolls on said other surface in opposition to said pinion with longitudinal movement of said carriage, whereby said roller resists horizontal movement of said rack away from said pinion.

5. A carriage moving mechanism, comprising:

a carriage mounted for movement in a longitudinal direction on a longitudinally extending guide shaft;

a traveling motor fixedly mounted on said carriage, said traveling motor including a pinion mounted on a rotary shaft thereof;

a rack extending substantially in parallel to said guide shaft; said rack being rigid longitudinally and flexible in a flex direction perpendicular to said longitudinal direction, said rack having a longitudinally extending tooth surface engaged with said pinion, another surface of said rack located opposite to said tooth surface being substantially parallel to said guide shaft, said tooth surface and said other surface being spaced apart in said flex direction;

a roller rotatably mounted on said carriage, said roller radially facing said pinion and making contact with said other surface of said rack so as to resist disengagement of said tooth surface from such pinion;

an elastic member; and a frame, said rack being pivotably mounted to said frame for pivotal movement about an axis perpendicular to said longitudinal direction and said flex direction, said rack being elastically connected to said frame at an end of said rack opposite said one end through said elastic member so as to elastically resist disengagement of said tooth surface from said pinion.

6. A carriage moving mechanism as in claim 5, wherein said rack and said guide shaft are horizontally extending and horizontally spaced from each other, said direction perpendicular to said longitudinal direction being a horizontal direction so that said rack is flexible in a horizontal plane, said tooth surface and said other surface being formed on horizontally opposite sides of said rack, said roller and said pinion having vertically extending axes of rotation so that said roller rolls on said other surface in opposition to said pinion with longitudinal movement of said carriage, whereby said roller resists horizontal movement of said rack away from said pinion.

* * * * *